US011754263B2

(12) United States Patent
Fang et al.

(10) Patent No.: US 11,754,263 B2
(45) Date of Patent: Sep. 12, 2023

(54) DOWNLIGHT SUITABLE FOR EMBEDDED TUBES OF DIFFERENT SPECIFICATIONS

(71) Applicant: Hengdian Group Tospo Lighting Co., Ltd., Zhejiang (CN)

(72) Inventors: Hu Fang, Zhejiang (CN); Liang Chen, Zhejiang (CN); Yufei Zhu, Zhejiang (CN); Fang Wang, Zhejiang (CN)

(73) Assignee: Hengdian Group Tospo Lighting Co., Ltd., Zhejiang (CN)

( * ) Notice: Subject to any disclaimer, the term of this patent is extended or adjusted under 35 U.S.C. 154(b) by 0 days.

(21) Appl. No.: 17/717,314

(22) Filed: Apr. 11, 2022

(65) Prior Publication Data

US 2023/0061006 A1 Mar. 2, 2023

(30) Foreign Application Priority Data

Aug. 31, 2021 (CN) ..... 202122086623.3

(51) Int. Cl.
*F21V 21/04* (2006.01)
*F21V 19/04* (2006.01)
*F21S 8/02* (2006.01)

(52) U.S. Cl.
CPC ..... *F21V 21/04* (2013.01); *F21S 8/026* (2013.01); *F21V 19/04* (2013.01)

(58) Field of Classification Search
CPC ..... F21V 21/04; F21V 19/04; F21V 19/001; F21V 21/044; F21S 8/026
See application file for complete search history.

(56) References Cited

U.S. PATENT DOCUMENTS 9,739,455 B2 * 8/2017 Rodriguez ..... F21V 19/04
10,281,120 B1 * 5/2019 Winslett ..... F16M 13/022
11,384,910 B1 * 7/2022 Cohen ..... F21V 29/777
2018/0172898 A1 * 6/2018 Blessitt ..... F21S 8/026
2019/0120448 A1 * 4/2019 Li ..... F21V 21/04

FOREIGN PATENT DOCUMENTS

FR 2978509 * 2/2013 ..... F21V 21/04

OTHER PUBLICATIONS

English Translation, FR 2978509, published Feb. 2013, Naboulet (Year: 2013).*

* cited by examiner

*Primary Examiner* — Peggy A Neils

(74) *Attorney, Agent, or Firm* — The Dobrusin Law Firm, PC

(57) ABSTRACT

The present utility model discloses a downlight that belongs to the technical field of downlights and is suitable for embedded tubes of different specifications; the downlight includes a lamp cup; a drive board is arranged inside the lamp cup, and a light source board is arranged below the drive board; a lampshade is arranged below the lamp cup, and two symmetrically arranged mounts are arranged on the lamp cup; and a spring is rotatably embedded in the mount. The spring of the present utility model can be rotated in the mount along the transverse axle at the bottom of the installation bracket, so as to adjust the relative distance between the two springs, such that one downlight can be applied to the installed embedded tubes of different specifications, thereby saving the cost of manufacturers in inventory storage and reducing the models of downlights purchased by users; the present utility model uses a triangular limit block, which has a horizontal bottom face for limiting the spring and an inclined side face for installing the spring.

6 Claims, 3 Drawing Sheets

DOWNLIGHT SUITABLE FOR EMBEDDED TUBES OF DIFFERENT SPECIFICATIONS

FIELD OF THE UTILITY MODEL

The present utility model belongs to the technical field of downlights, and in particular relates to a downlight suitable for embedded tubes of different specifications.

BACKGROUND OF THE UTILITY MODEL

A downlight is a lamp with a screw base where incandescent or energy-saving lamps can be directly installed. It is a concealed lighting fixture embedded in the ceiling and casting all the light downward, which belongs to direct light distribution. Different reflectors, lenses, shutters and bulbs can be used to achieve different light effects. The downlight does not take up space and can add a soft atmosphere to the space; if you want to create a warm feeling, you can try to install multiple downlights to reduce the oppression of the space. It is generally used in hotels, homes, and cafes.

The embedded tubes of downlights currently on the market have different specifications. A downlight will have certain limitations if it can only be installed in a embedded tube of one specification, which is because a customer's home may have installation environments of different sizes, and downlights of one size cannot be fully compatible, so the customer has to buy downlights of different sizes.

CONTENTS OF THE UTILITY MODEL

In order to solve the problems mentioned above, the present utility model provides a downlight suitable for embedded tubes of different specifications, which is suitable for installation in the embedded tubes of different specifications.

In order to achieve the above object, the present utility model proposes the following technical solution: A downlight suitable for embedded tubes of different specifications is provided, including a lamp cup; a drive board is arranged inside the lamp cup, and a light source board is arranged below the drive board; a lampshade is arranged below the lamp cup, and two symmetrically arranged mounts are arranged on the lamp cup; and a spring is rotatably embedded in the mount.

Further, a limit plate is arranged inside the mount, and a limit block is arranged on one side of the limit plate, so as to limit the spring such that the rotation of the spring is not affected while the spring is installed.

Further, the limit block is triangular with a horizontal bottom face and an inclined side face, so as to facilitate the installation of the spring and realize the limit to the spring.

Further, the spring includes an installation bracket connected with two elastic arms, so as to install the lamp cup.

Further, the installation bracket is U-shaped, so as to enable the spring to rotate along the transverse axle.

Further, the elastic arm is provided at the end with a lifting lug, so as to facilitate wiring and avoid damage to the human body caused by the sharp structure.

Further, a rotation groove is provided between both sides of the limit block and the inner wall of the mount, so as to provide space for the rotation of the spring.

The present utility model has the following beneficial effects compared to the prior art:

1. The spring of the present utility model can be rotated in the mount along the transverse axle at the bottom of the installation bracket, so as to adjust the relative distance between the two springs, such that one downlight can be applied to the installed embedded tubes of different specifications, thereby saving the cost of manufacturers in inventory storage and reducing the models of downlights purchased by users;

2. the limit block of the present utility model is triangular, having a horizontal bottom face for limiting the spring and an inclined side face for installing the spring.

BRIEF DESCRIPTION OF THE DRAWINGS

The attached drawings are used to help further understanding of the present utility model. They constitute a part of the description and are used to explain the present utility model in combination with the examples of the present utility model, but do not constitute a limitation on the present utility model. In the drawings.

List of reference numbers: 1. lampshade; 2. light source board; 3. drive board; 4. lamp cup; 5. spring; 51. installation bracket; 511. transverse axle; 52. elastic arm; 53. lifting lug; 6. mount; 7. limit plate; 71. limit block; 711. horizontal bottom face; 712. inclined side face; and 8. rotation groove.

DETAILED DESCRIPTION OF THE EMBODIMENTS

The technical solutions in the examples of the present utility model will be described clearly and completely in the following in combination with the drawings therein. Obviously, these examples are only some, but not all, of the examples of the present utility model. All the other examples obtained by those of ordinary skill in the art based on the examples of the present utility model without creative efforts shall fall within the scope of protection of the present utility model.

Example 1

Figure 1:
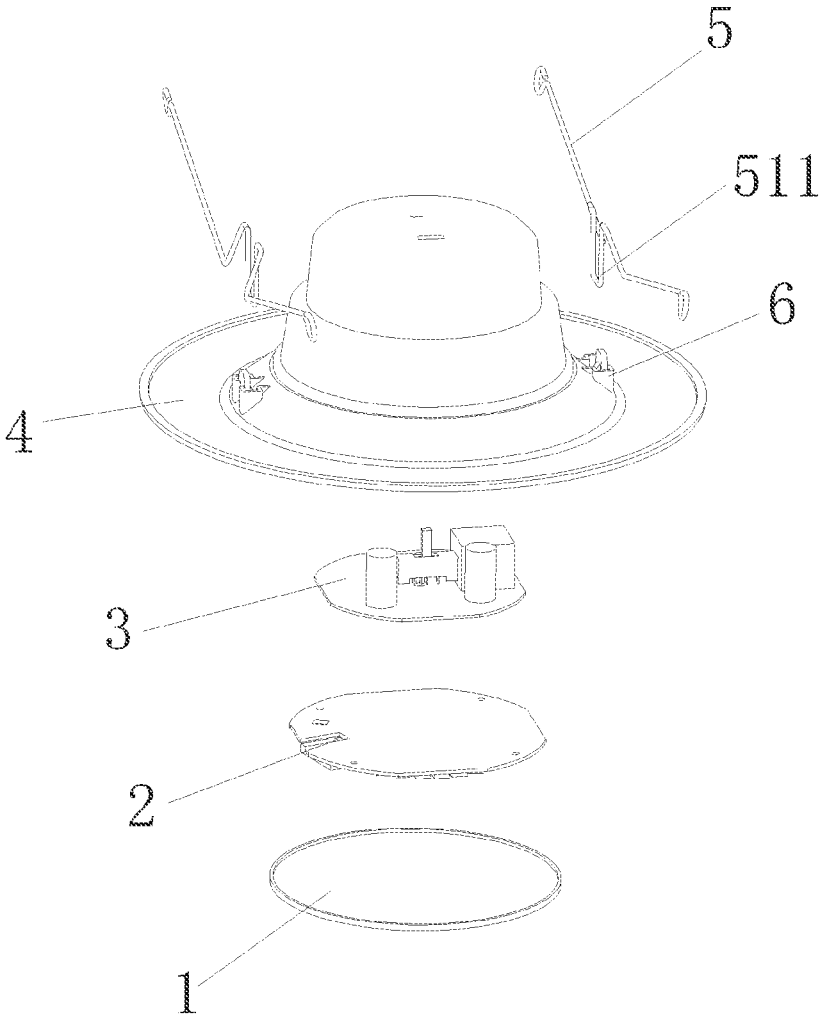
FIG. 1 is an exploded structural diagram of the present utility model.
Figure 2:
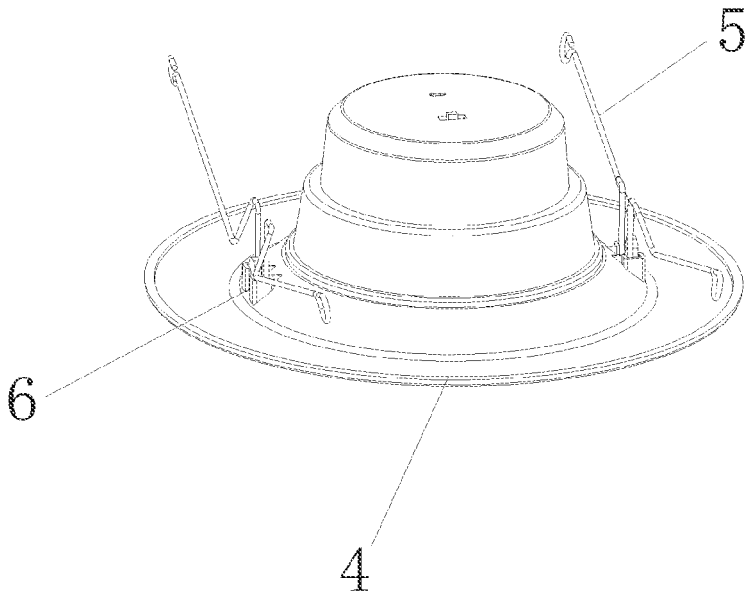
FIG. 2 is a structural diagram of the present utility model.
Figure 3:
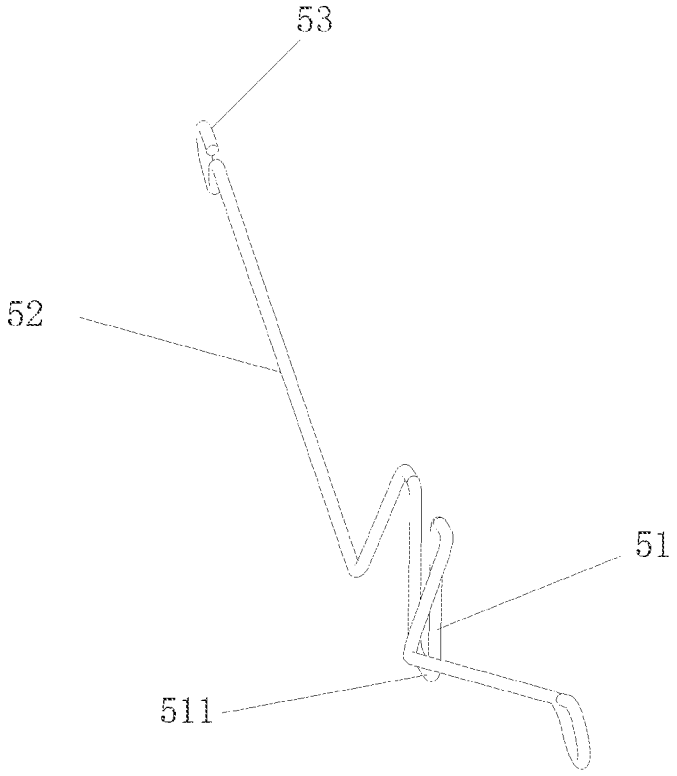
FIG. 3 is a structural diagram of the spring of the present utility model.
Figure 4:
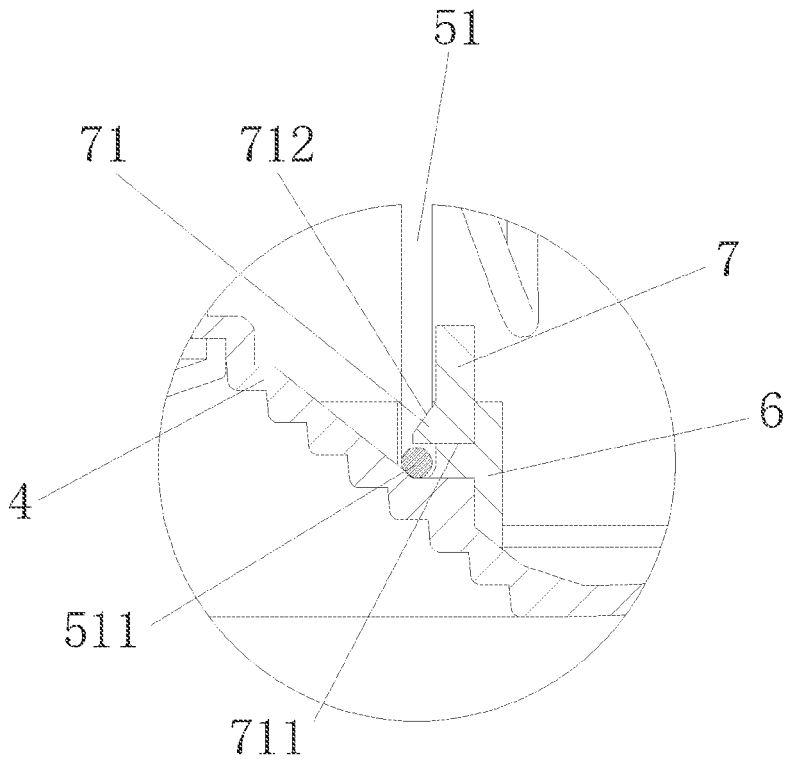
FIG. 4 is a cross-sectional structural diagram of the connection between the spring and the mount of the present utility model.
Figure 5:
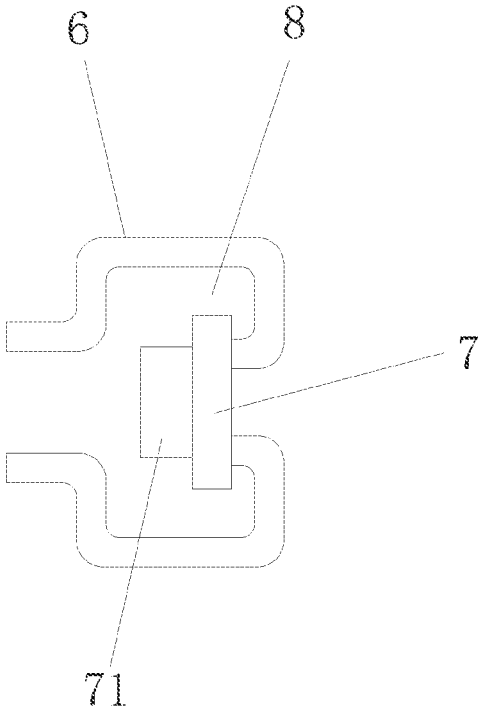
FIG. 5 is a structural diagram of the mount of the present utility model.

As shown in FIGS. 1-5, the present utility model proposes the following technical solution: A downlight suitable for embedded tubes of different specifications is provided, including a lamp cup 4; a drive board 3 is arranged inside the lamp cup 4, and a light source board 2 is arranged below the drive board 3; a lampshade 1 is arranged below the lamp cup 4, and two symmetrically arranged mounts 6 are arranged on the lamp cup 4; and a spring 5 is rotatably embedded in the mount 6.

Specifically, a limit plate 7 is arranged inside the mount 6, and a limit block 71 is arranged on one side of the limit plate 7.

By the above technical solution, the spring 5 is limited by the limit block 71, so that the rotation of the spring 5 is not affected while the spring 5 is installed.

Specifically, the limit block 71 is triangular with a horizontal bottom face 711 and an inclined side face 712.

By the above technical solution, the inclined side face 712 of the limit block 71 facilitates the installation of the spring 5, and the horizontal bottom face 711 of the limit block 71 realizes the limit to the spring 5.

Specifically, the spring 5 includes an installation bracket 51, which is connected with two elastic arms 52.

By the above technical solution, the lamp cup 4 is installed through the elastic arm 52.

Specifically, the installation bracket 51 is U-shaped.

By the above technical solution, after the transverse axle 511 at the bottom of the installation bracket 51 is inserted into the mount 6, the spring 5 can be rotated along the transverse axle 511.

Example 2

Example 2 is distinguished from Example 1 specifically in that the elastic arm 52 is provided at the end with a lifting lug 53.

By the above technical solution, the lifting lug 53 can be temporarily buckled in the spring clamping position of the embedded tube during installation, so as to facilitate wiring and avoid damage to the human body caused by the sharp structure.

Example 3

Example 3 is distinguished from Example 1 specifically in that a rotation groove 8 is provided between both sides of the limit block 71 and the inner wall of the mount 6.

By the above technical solution, space is provided for the rotation of the spring 5.

To sum up, the spring 5 of the present utility model can be rotated in the mount 6 along the transverse axle 511 at the bottom of the installation bracket 51, so as to adjust the relative distance between the two springs 5, such that one downlight can be applied to the installed embedded tubes of different specifications, thereby saving the cost of manufacturers in inventory storage and reducing the models of downlights purchased by users; the limit block 71 of the present utility model is triangular, having a horizontal bottom face 711 for limiting the spring 5 and an inclined side face 712 for installing the spring 5.

It should be noted that the above examples are only preferred examples of the present utility model, not intended to limit the present utility model. Although the present utility model has been described in detail with reference to the foregoing examples, those skilled in the art can still modify the technical solutions in the foregoing examples, or equivalently replace some of the technical features therein. Any modification, equivalent replacement, improvement and the like made within the spirit and principle of the present utility model shall be included within the scope of protection of the present utility model.

The invention claimed is:

1. A downlight suitable for embedded tubes of different specifications, including a lamp cup, wherein a drive board is arranged inside the lamp cup, and a light source board is arranged below the drive board; a lampshade is arranged below the lamp cup, and two symmetrically arranged mounts are arranged on the lamp cup; and a spring is rotatably embedded in the mount; and wherein the spring includes an installation bracket, the installation bracket is U-shaped, two elastic arms are connected at a top of the installation bracket, a transverse axle at a bottom of the installation bracket is inserted into the mount, the spring is capable of being rotated about the transverse axle.

2. The downlight suitable for embedded tubes of different specifications according to claim 1, wherein a limit plate is arranged inside the mount.

3. The downlight suitable for embedded tubes of different specifications according to claim 2, wherein a limit block is arranged on one side of the limit plate, the transverse axle is arranged between the limit block and the lamp cup.

4. The downlight suitable for embedded tubes of different specifications according to claim 3, wherein the limit block is triangular with a horizontal bottom face and an inclined side face, the transverse axle is arranged between the lamp cup and the horizontal bottom face of the limit block.

5. The downlight suitable for embedded tubes of different specifications according to claim 1, wherein the elastic arm is provided at the end with a lifting lug.

6. The downlight suitable for embedded tubes of different specifications according to claim 3, wherein a rotation groove is provided between both sides of the limit block and an inner wall of the mount.

* * * * *